US006439144B1

(12) United States Patent
Chen

(10) Patent No.: US 6,439,144 B1
(45) Date of Patent: Aug. 27, 2002

(54) METHOD OF MAKING FLOWER-SHAPED BATH SCRUBBER

(76) Inventor: Yi-Chun Chen, 5F, No. 168, Sec. 5, Nan-Ching E. Rd., Taipei (TW)

( * ) Notice: Subject to any disclaimer, the term of this patent is extended or adjusted under 35 U.S.C. 154(b) by 66 days.

(21) Appl. No.: 09/749,888

(22) Filed: Dec. 29, 2000

(51) Int. Cl.[7] ..... D05B 97/00; A46B 15/00

(52) U.S. Cl. ..... 112/475.06; 15/229.11

(58) Field of Search ..... 112/475.06, 156, 112/470.36, 1; 300/21; 28/147, 150; 15/229.11, 229.13, 222; 223/44, 46

(56) References Cited

U.S. PATENT DOCUMENTS 1,568,859 A * 1/1926 Sas ..... 112/475.06
3,922,407 A * 11/1975 Nimmo, Jr. et al.
4,206,948 A * 6/1980 Shimizu ..... 300/21
5,645,902 A * 7/1997 Cheng
5,946,780 A * 9/1999 Borcherds et al. ..... 28/147

* cited by examiner

*Primary Examiner*—Ismael Izaguirre
(74) *Attorney, Agent, or Firm*—Bacon & Thomas, PLLC

(57) ABSTRACT

A method of making flower-shaped bath scrubber uses a bar as the support to pierce through a netting band which is folded at one end, then use the bar as an axis to have the remaining netting band run through one end of the bar. Then move the netting band laterally along the bar to another end and have the remaining netting band run through the bar from another end. The foregoing process is repeatedly performed until the netting band is completely disposed on the bar. Then fasten one end of the netting band and remove the bar. The wound around netting band then may be unfolded and stretched to form a shape desired. After another fastening, a flower-shaped netting bath scrubber will be formed.

7 Claims, 10 Drawing Sheets

METHOD OF MAKING FLOWER-SHAPED BATH SCRUBBER

BACKGROUND OF THE INVENTION

This invention relates to a netting bath scrubber and particularly a method that uses a netting band and one or two bars for making a flower-shaped netting bath scrubber.

Conventionally, when people taking bath to clean the body, they usually rub the soap over the wetted body and scrub the body to generate soap foam or bubbles, then rinse the body to wash the soap foam away. However for people who have a lot of physical activities and have accumulated a lot of perspiration and dirt on their skin, using merely water and soap to clean the body is not enough. Some physical means have to be used to thoroughly remove the accumulated dirt and sweat from the body. Netting bath scrubber is one of the bathing articles that have gained growing acceptance among people in recent years.

However the netting bath scrubbers now available in the market place are mostly made of one layer of netting sheet. It cannot adsorb sufficient amount of soap foams. In order to adsorb more soap and foams, the netting cloth has to be folded and stacked for a number of times to become a multiple layer form. But this type of impromptu scrubber made by users during bathing is easily to fall apart when used and may become an annoyance to users.

There are prior art being disclosed for making the netting bath scrubber more convenient to use. For instance, U.S. Pat. No. 5,709,434 and 5,946,780 taught methods of making netting bath scrubber or ruffles. They generally use two bracing members or support members for gathering a netting tube. The resulting netting structure is not very sturdy. The twisting and squeezing exerted on the netting scrubber during bathing could easily break their structure and result in dropping of soap adsorption capability.

U.S. Pat. No. 5,144,744 discloses another method for making netting sponge. It includes four supports for stretching two netting tubes, then binds the stretched tubes together. Basically, it is not much different from the methods of using two supports set forth above, and the finished product still has same sort of problems. All the methods disclosed above need tools and have tedious process. The netting scrubbers or sponges being made look plain without much appealing.

SUMMARY OF THE INVENTION

In view of aforesaid disadvantages, it is therefore an object of this invention to provide an improved method that uses one or two bars and a netting band for making a flower-shaped netting bath scrubber.

In one aspect, the method of this invention uses a bar as the support to run through a netting band which is folded at one end, then use the bar as an axis to have the remaining netting band run through one end of the bar. Then move the netting band laterally along the bar to another end and have the remaining netting band run through the bar from another end. The foregoing process is repeatedly performed until the netting band is completely disposed on the bar, Then fasten one end of the netting band and remove the bar. The wound around netting band then may be unfolded and stretched to form a shape desired. After another fastening, a flower-shaped netting bath scrubber will be formed.

BRIEF DESCRIPTION OF THE DRAWINGS

The invention, as well as its many advantages, may be further understood by the following detailed description and drawings, in which.

DESCRIPTION OF THE PREFERRED EMBODIMENTS

Figure 1A:
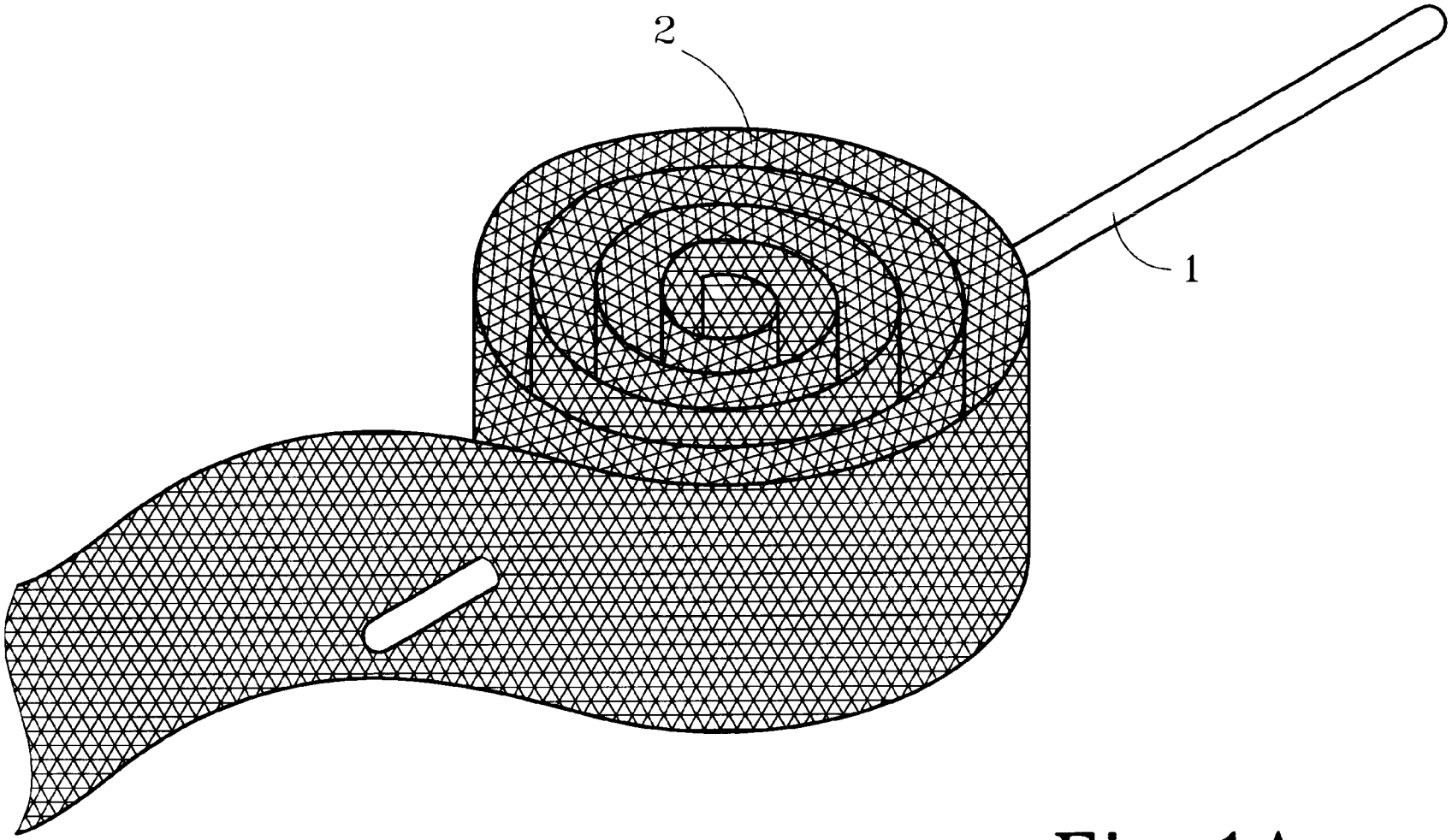
FIG. 1A is a perspective view of the first step of this invention.
Figure 1B:
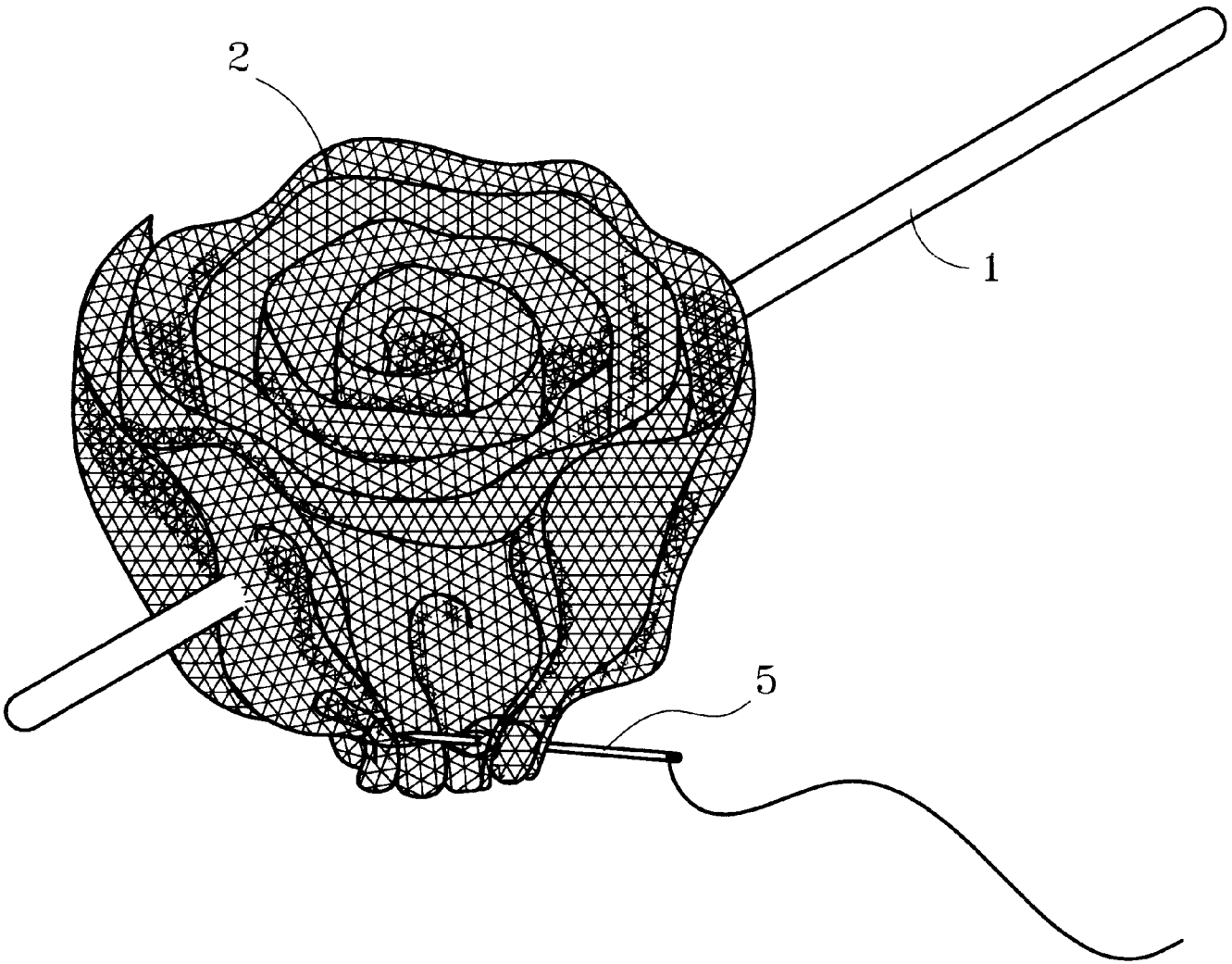
FIG. 1B is a perspective view of the second step of this invention.
Figure 1C:
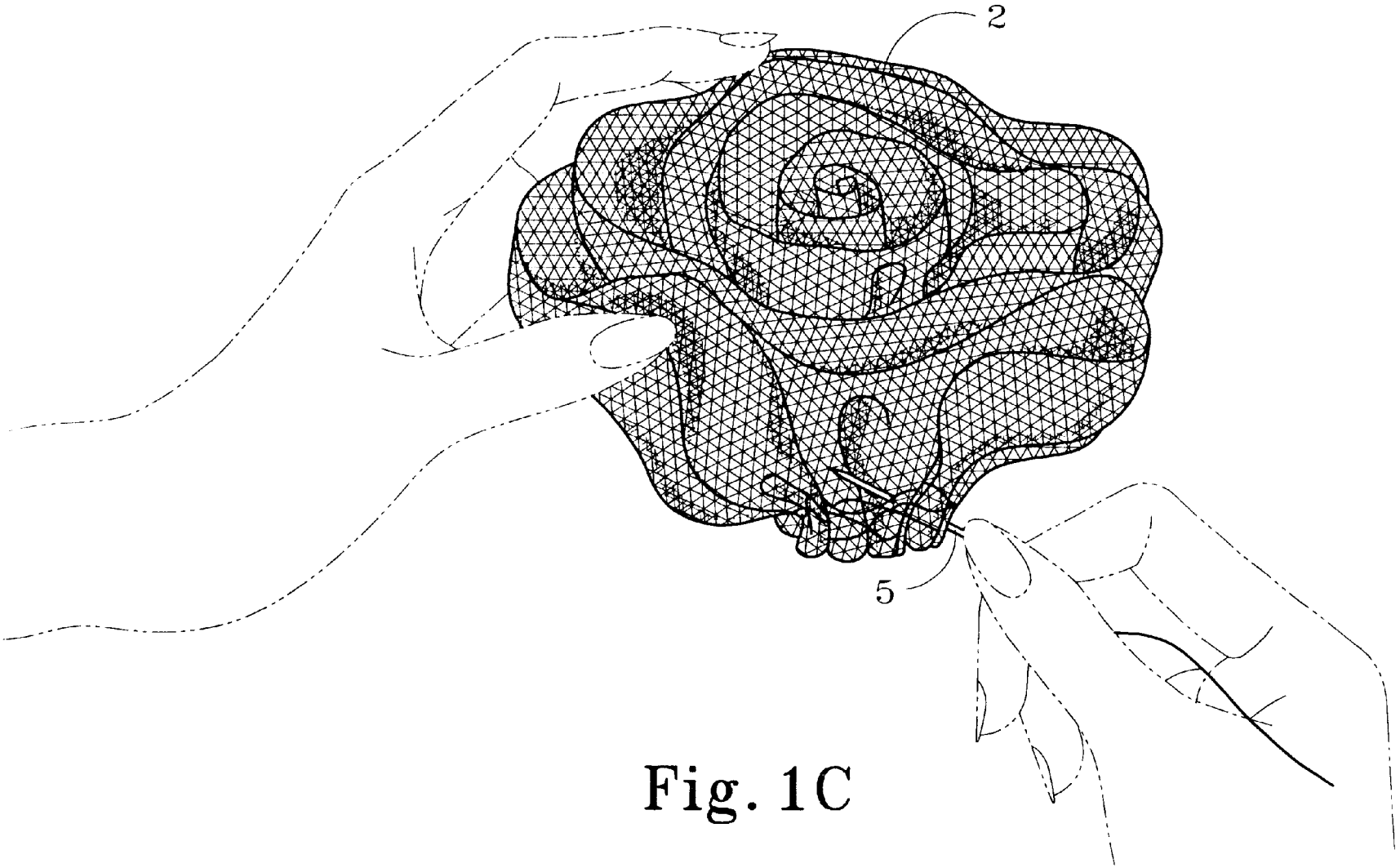
FIG. 1C is a perspective view of the third step of this invention.
Figure 2:
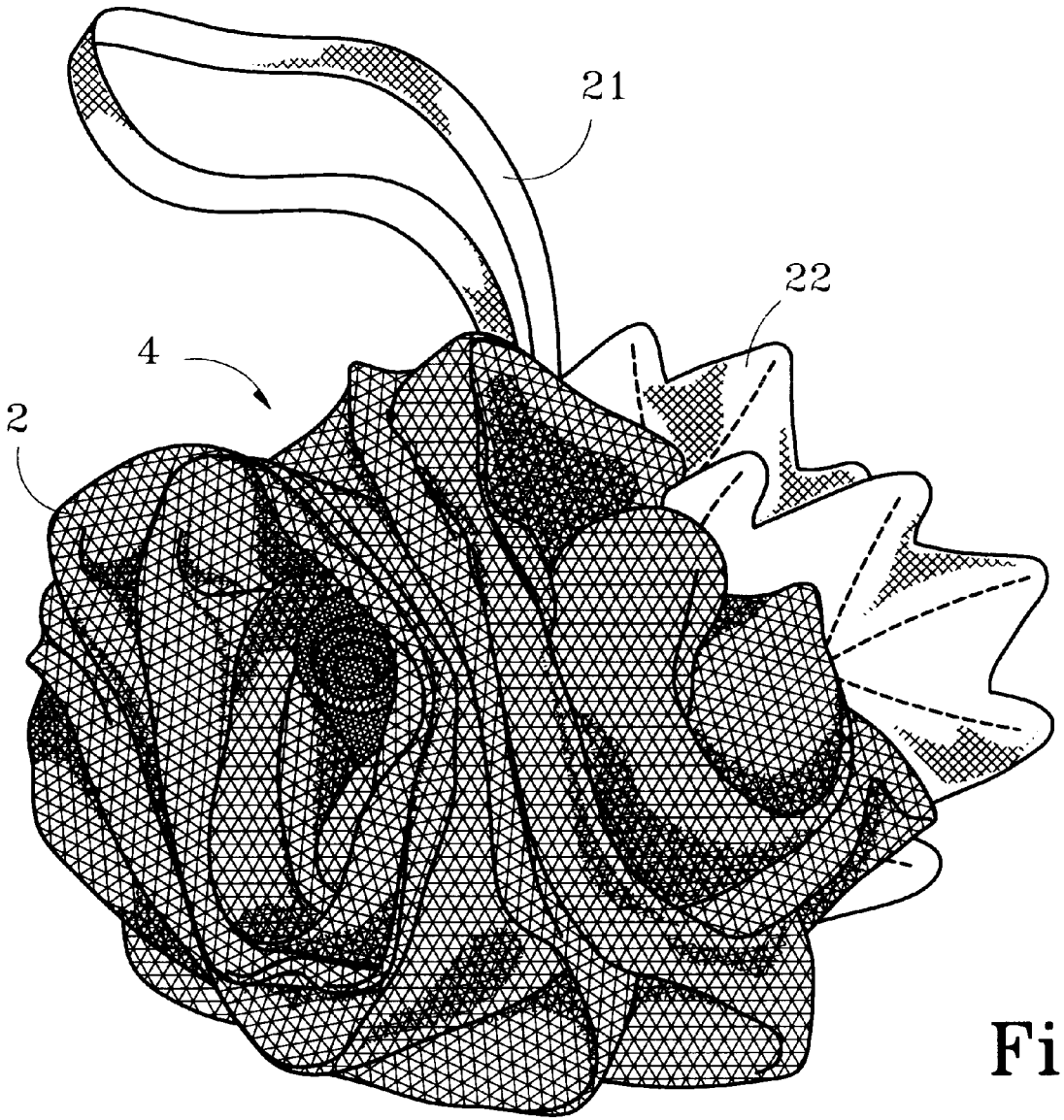
FIG. 2 is a pictorial view of a finished netting bath scrubber according to this invention.
Figure 3:
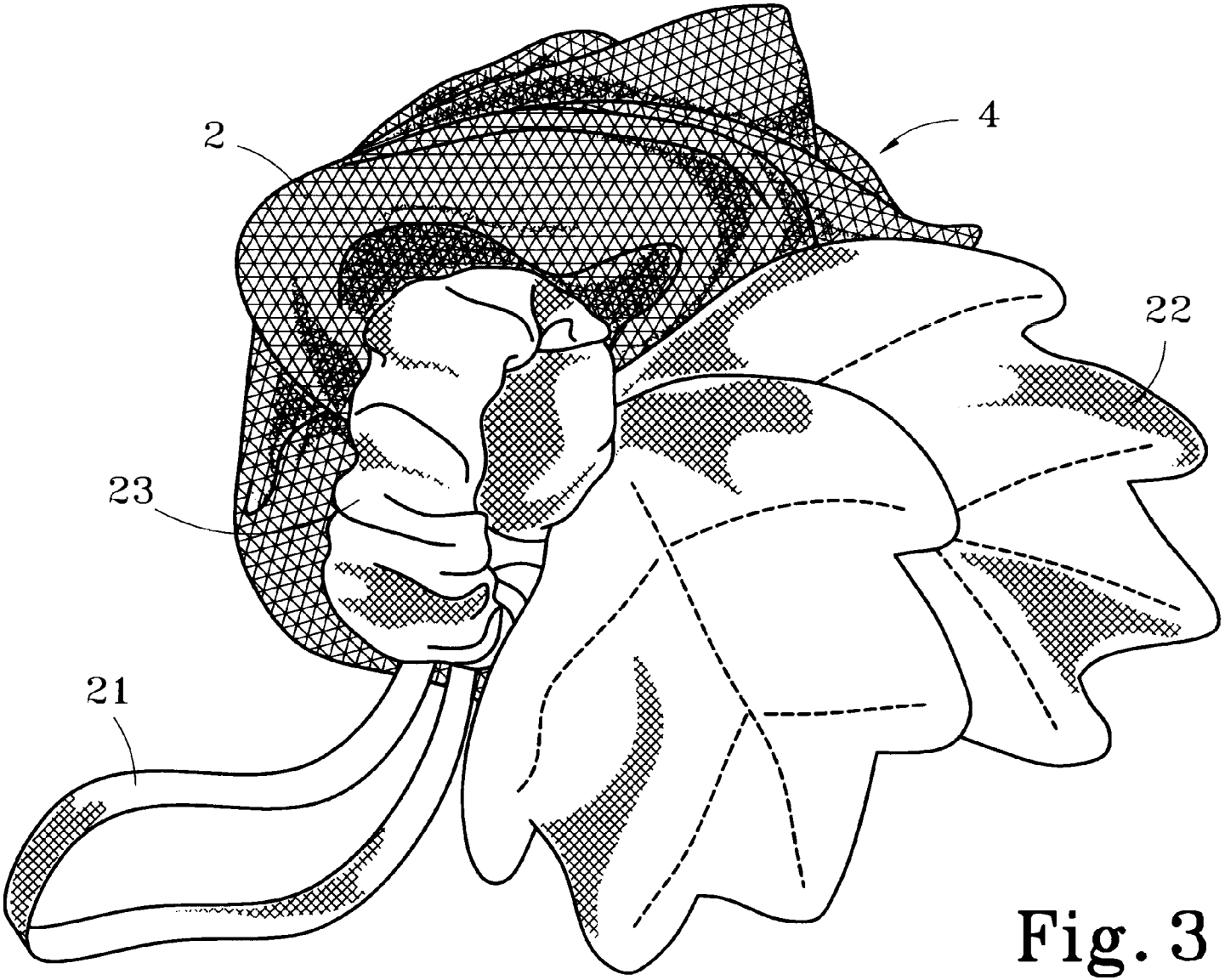
FIG. 3 is another pictorial view of a finished netting bath scrubber according to this invention.

Referring to FIGS. 1A through 3, the method of making a flower-shaped netting bath scrubber 4 according to this invention includes the following steps:

a. using a bar 1 which has two smooth ends for support, folding a Polyethylene (PE) netting band 2 at one end thereof at a selected location, then using a first end of the bar 1 to pierce through the netting band 2 at a selected spot of the folded portion;

b. using the bar 1 as an axis to move the remaining netting band laterally to a second end of the bar 1, using the second end to pierce through the remaining netting band 2, then repeating the process set forth above until all the remaining netting band 2 has been disposed on the bar 1; and c. fastening either end of the netting band 2 held on the bar 1, removing the bar 1 away from the fastened netting band 2, unfolding and stretching the fastened netting band 2 to a form desired, and fixing the fastened netting band 2 to become a bath scrubber 4 in a flower-shaped desired.

The fastening and fixing of the netting band 2 may be done through a stitching means 5. After the flower-shaped bath scrubber 4 is formed, it may be added with accessories desired through the stitching means 5, such as a strap 21, an ornament 22, a girdle 23 or the like. The strap 21 may enable users to grab the netting scrubber 4 securely during bathing and to hang the netting scrubber 4 for drying after bathing. The girdle 23 may be used for tying users hair during bathing.

Figure 4A:
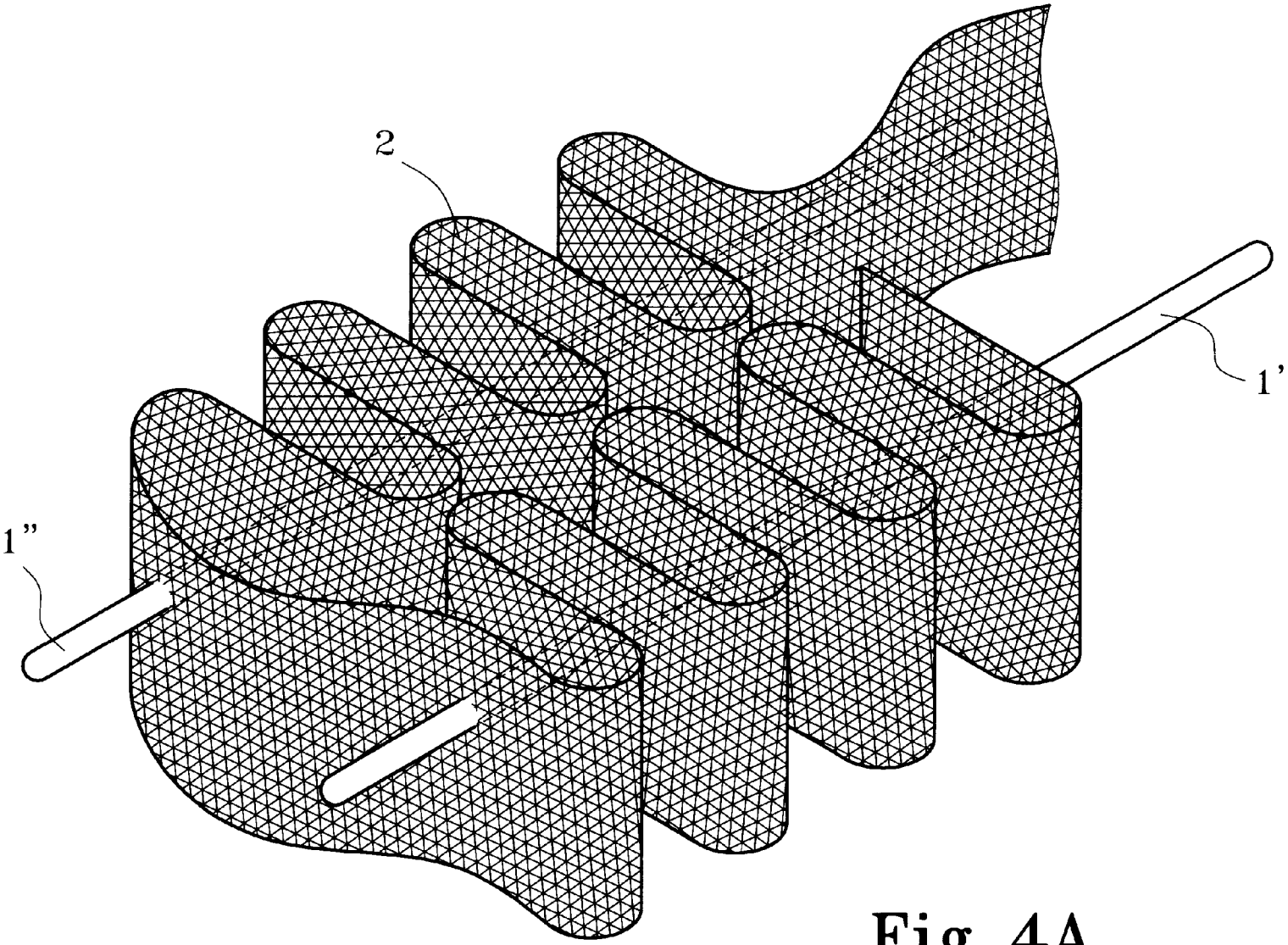
FIG. 4A is a perspective view of the first step of an embodiment of this invention.
Figure 4B:
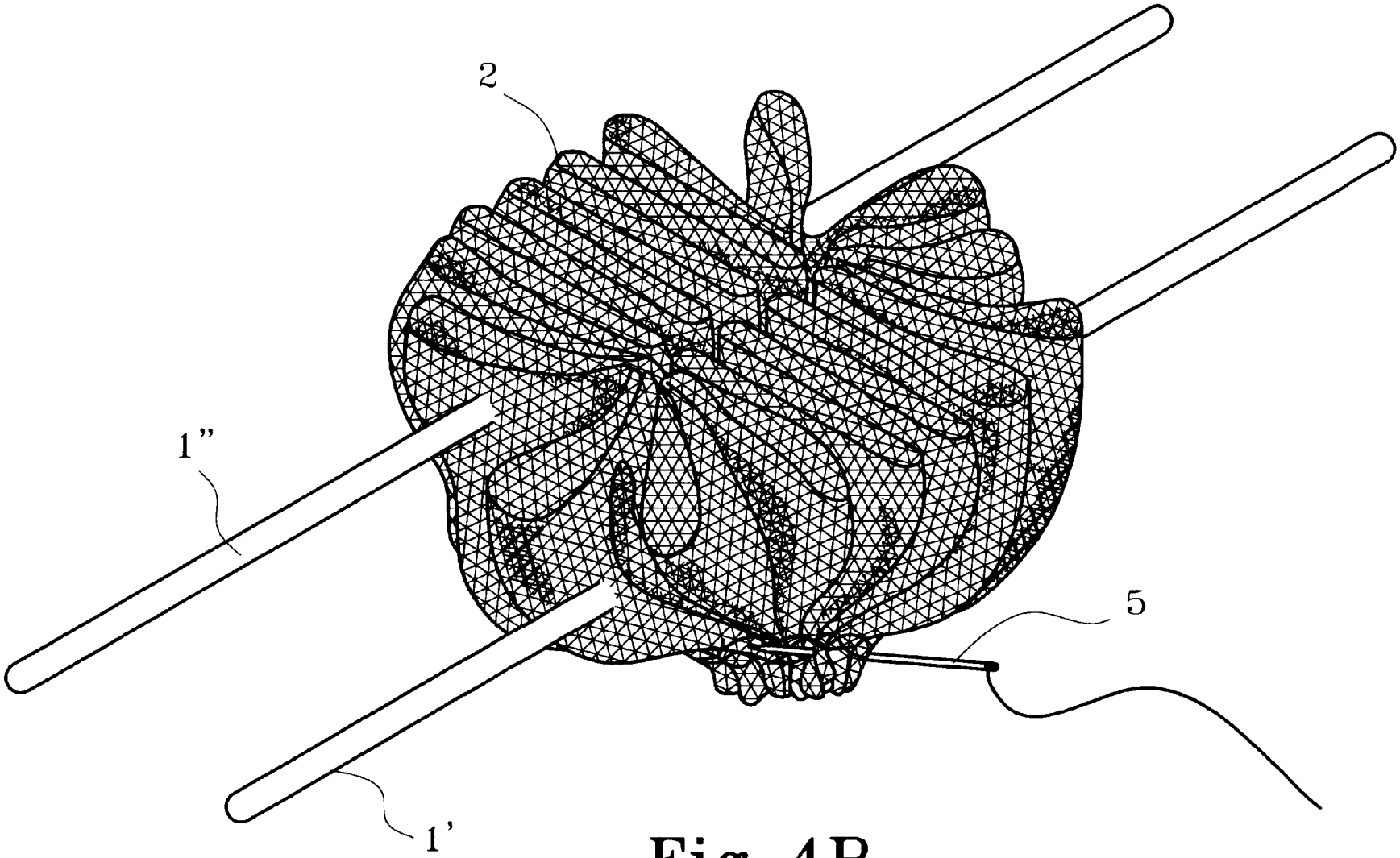
FIG. 4B is a perspective view of the second step of an embodiment of this invention.
Figure 4C:
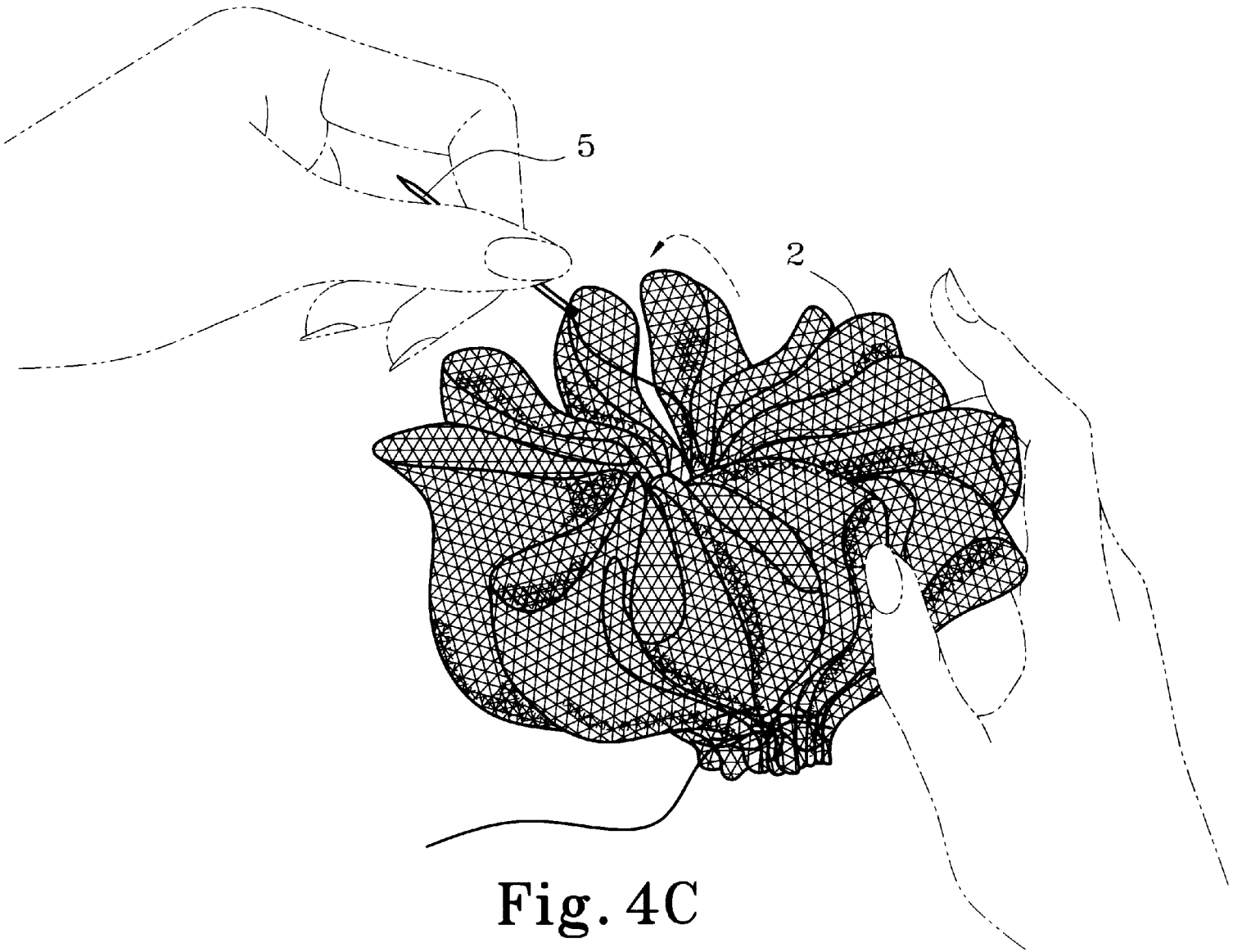
FIG. 4C is a perspective view of the third step of an embodiment of this invention.
Figure 5:
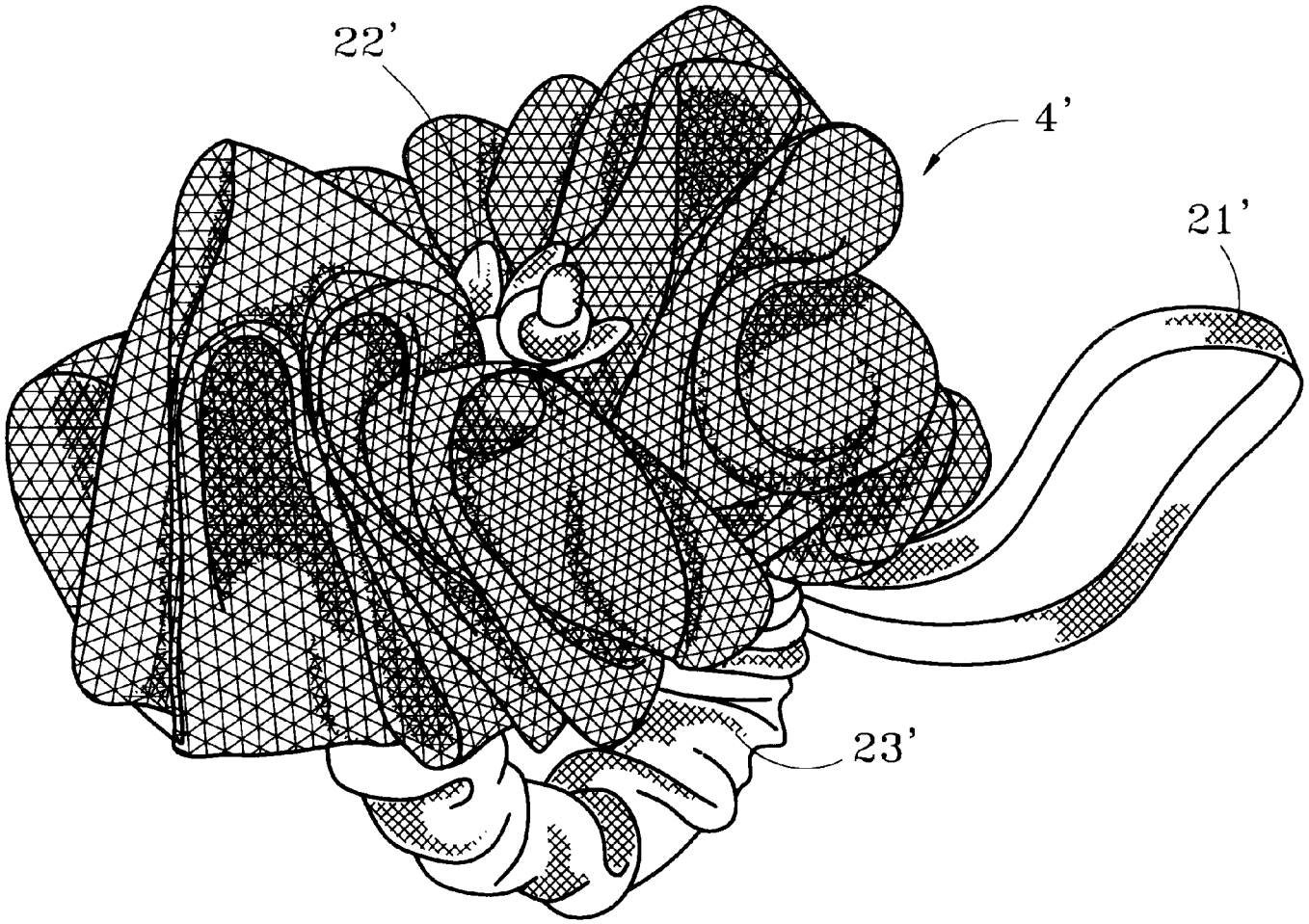
FIG. 5 is a pictorial view of a finished. netting bath scrubber according to the embodiment of this invention.
Figure 6:
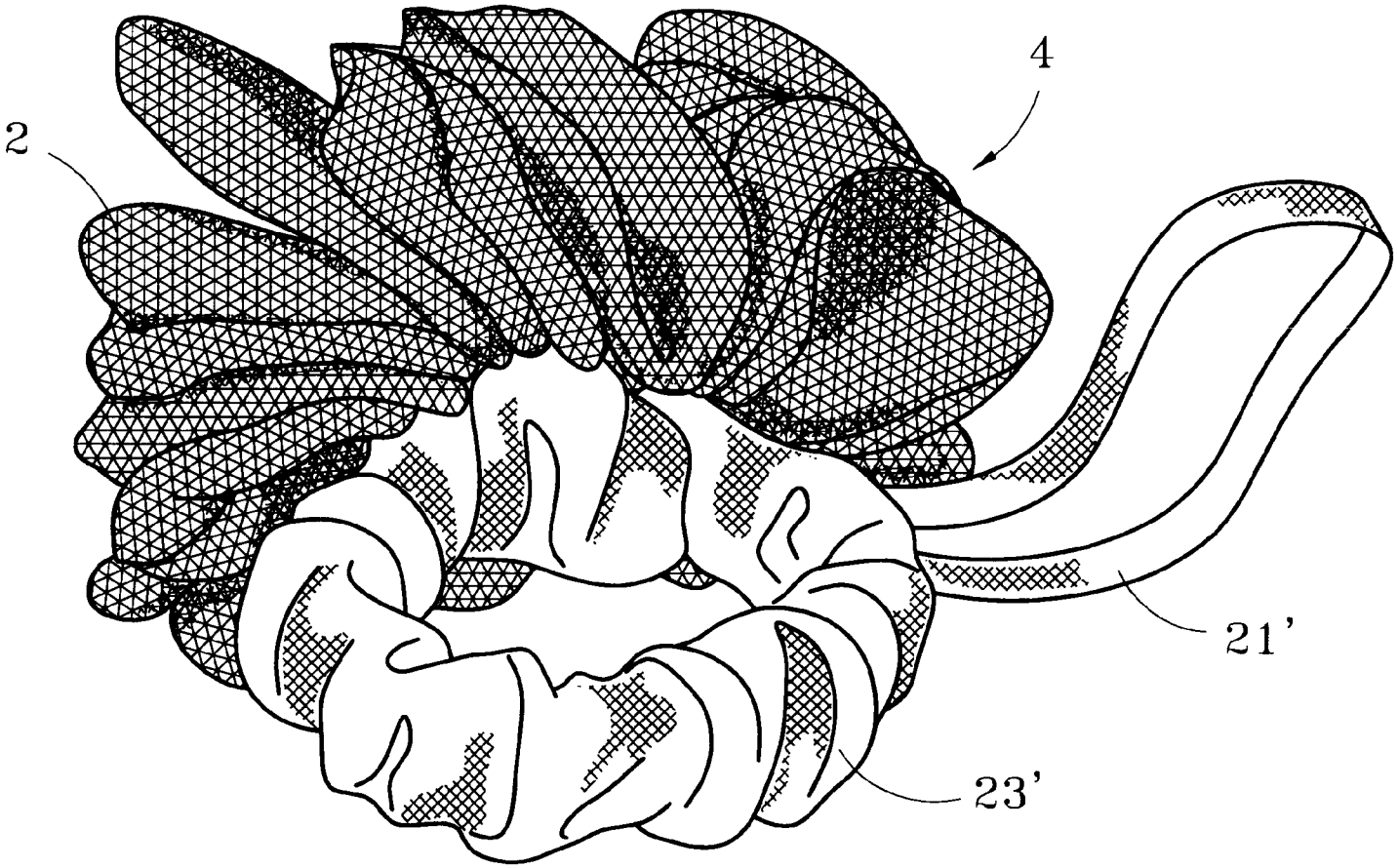
FIG. 6 is another pictorial view of a finished netting bath scrubber according to the embodiment of this invention.

FIGS. 4A through 6 illustrate an embodiment of this invention. The method of making a flower-shaped netting bathing scrubber 4' includes the following steps:

a. using two bars 1' and 1" for support, folding a PE netting band 2 at one end thereof at a selected location, then using the bars 1' and 1" to pierce through the netting band 2 at selected spots of the folded portion, the bars 1 and 1' maintain parallel with each other;

b. using one end of the bars 1' and 1" to pierce through the remaining netting band 2 repeatedly with the remaining netting band 2 in a folding manner until all the remaining netting band 2 has been disposed on the bars 1' and 1"; and c. fastening either end of the netting band 2 held on the bars 1' and 1", removing the bars 1 and 1' away from the fastened netting band 2, unfolding and stretching the fastened netting band 2 to a form desired, and fixing the fastened netting band 2 to become a bath scrubber 4' in a flower-shaped desired.

The fastening and fixing of the netting band 2 may be done through a stitching means 5. After the flower-shaped bath scrubber 4' is formed, it may be added with accessories desired through the stitching means 5, such as a strap 21', an ornament 22', a girdle 23' or the like. The trap 21' may enable users to grab the netting scrubber 4' securely during bathing and to hang the netting scrubber 4' for drying after bathing. The girdle 23' may be used for tying user's hair during bathing.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A method of making a flower-shaped bath scrubber, comprising:

a. folding a netting band at one end thereof at a selected location, using a bar to pierce through the netting band at the folded portion from a first end of the bar;

b. using the bar as an axis to move remaining netting band laterally to a second end thereof, using the second end of the bar to pierce through the remaining netting band, and repeating the foregoing steps until all the remaining netting band has been disposed on the bar; and c. fastening either end of the netting band held on the bar, removing the bar away from the fastened netting band, unfolding and stretching the fastened netting band to a form desired, and fixing the fastened netting band to become the bath scrubber in a flower-shaped desired.

2. The method according to claim 1, wherein the first and second end of the bar are smooth.

3. The method according to claim 1, wherein the netting band is made of polyethylene.

4. The method according to claim 1, wherein the fastening and fixing are done by stitching.

5. The method according to claim 1 further including stitching a strap, an ornament and a girdle on the bath scrubber for grabbing, hanging and tying hair use.

6. A method of making a flower-shaped bath scrubber, comprising:

a. folding a netting band at one end thereof at a selected location, using two bars to pierce through the netting band at the folded portion;

b. using one end of the bars to pierce through remaining netting band repeatedly with the remaining netting band in a folding manner until all the remaining netting band has been disposed on the bars; and c. fastening either end of the netting band held on the bars, removing the bars away from the fastened netting band, unfolding and stretching the fastened netting band to a form desired, and fixing the fastened netting band to become the bath scrubber in a flower-shaped desired.

7. The method according to claim 6, wherein the two bars pierce through the netting band in a parallel manner.

* * * * *